US009320364B2

(12) United States Patent
Mills et al.

(10) Patent No.: US 9,320,364 B2
(45) Date of Patent: Apr. 26, 2016

(54) HELMET DISPENSING SYSTEM

(71) Applicant: HelmetHub, Somerville, MA (US)

(72) Inventors: Charles Mills, Salem, OR (US); Jessica Artilles, Cambridge, MA (US); Jose Avedillo, Laredo, TX (US); Kathryn Barnes, Boston, MA (US); Ignatius Chen, Boston, MA (US); Danielle Hicks, Somerville, MA (US); Shen Huang, Boston, MA (US); Ron Perez, Woodlands, TX (US); Laura Ware, Allston, MA (US); Stephanie Whalen, Newport Beach, CA (US); Breanna Berry, Boston, MA (US); Arni Lehto, Boston, MA (US); Angela Chu, Somerville, MA (US); Manas Menon, Somerville, MA (US)

(73) Assignee: HelmutHub Corporation, Somerville, MA (US)

( * ) Notice: Subject to any disclaimer, the term of this patent is extended or adjusted under 35 U.S.C. 154(b) by 0 days.

(21) Appl. No.: 14/322,606

(22) Filed: Jul. 2, 2014

(65) Prior Publication Data

US 2015/0008236 A1 Jan. 8, 2015

Related U.S. Application Data

(60) Provisional application No. 61/842,711, filed on Jul. 3, 2013.

(51) Int. Cl.
*G07F 11/02* (2006.01)
*A47F 1/04* (2006.01)
(Continued)

(52) U.S. Cl.
CPC ... *A47F 1/04* (2013.01); *A42B 3/00* (2013.01); *A47F 1/085* (2013.01); *G07F 7/00* (2013.01); *G07F 11/02* (2013.01); *G07F 11/04* (2013.01); *G07F 17/00* (2013.01); *A63B 71/0036* (2013.01)

(58) Field of Classification Search
CPC ..... A47F 1/065; A47F 1/085; A47F 1/106; A63B 71/0036
USPC ..... 221/197, 312 A
See application file for complete search history.

(56) References Cited

U.S. PATENT DOCUMENTS 4,915,205 A * 4/1990 Reid et al. ..... 194/205
5,865,341 A * 2/1999 Martin ..... B23K 9/202 221/197

(Continued)

FOREIGN PATENT DOCUMENTS

WO WO-2013/110020 7/2013

OTHER PUBLICATIONS

US Office Action on U.S. Appl. No. 14/322,613 dated Mar. 9, 2016.

*Primary Examiner* — Michael K Collins
(74) *Attorney, Agent, or Firm* — Foley & Lardner LLP; Christopher J. McKenna

(57) ABSTRACT

The present disclosure provides systems and methods for the dispensing and collection of objects in urban environments. More particularly, the disclosure provides systems and methods for dispensing and collecting helmets. The disclosure provides a self-sufficient, high-capacity, helmet dispensing system. In some embodiments, the system includes solar panels that provide the system with the requisite power needed to power the system. In some implementations, the system includes a vandal resistant return mechanism for the helmets. The system may also include communication modules, which may transmit system information to a backend server.

18 Claims, 9 Drawing Sheets

(51) Int. Cl.

| | |
|---|---|
| ***A42B 3/00*** | (2006.01) |
| ***A47F 1/08*** | (2006.01) |
| ***G07F 7/00*** | (2006.01) |
| ***G07F 11/04*** | (2006.01) |
| ***G07F 17/00*** | (2006.01) |
| *A63B 71/00* | (2006.01) |

(56) References Cited

U.S. PATENT DOCUMENTS

| | | | | |
|---|---|---|---|---|
| 6,112,944 | A | 9/2000 | Van Hoorn et al. | |
| 8,505,772 | B2 | 8/2013 | Martin | |
| 9,076,136 | B2 | 7/2015 | Bettez et al. | |
| 2007/0235400 | A1* | 10/2007 | Wald | A47F 7/00 211/85.7 |
| 2012/0116578 | A1* | 5/2012 | Zhang | 700/232 |
| 2012/0215346 | A1* | 8/2012 | Gingher | G07C 9/00571 700/237 |
| 2012/0271453 | A1* | 10/2012 | Alvarez | 700/232 |
| 2014/0207657 | A1* | 7/2014 | Gacs | G06Q 20/42 705/39 |
| 2014/0277706 | A1* | 9/2014 | Minnis | 700/237 |
| 2014/0332551 | A1* | 11/2014 | Zorick | G07F 11/54 221/121 |
| 2014/0379124 | A1* | 12/2014 | Dallaire | 700/237 |
| 2015/0008236 | A1* | 1/2015 | Mills et al. | 221/1 |
| 2015/0008237 | A1* | 1/2015 | Mills | A47F 1/04 221/1 |

* cited by examiner

HELMET DISPENSING SYSTEM

CROSS REFERENCE TO RELATED APPLICATION

This application claims the benefit of and priority to U.S. Provisional Patent Application No. 61/842,711, filed on Jul. 3, 2013 and titled "HELMET DISPENSING SYSTEM," which is incorporated herein by reference in its entirety.

BACKGROUND OF THE DISCLOSURE

Bike share programs are increasing in popularity in many urban environments. The bike share programs often include a distributed network of self-service pickup and drop off locations. Users may pick up a bike from one of the locations on an as-needed basis and return the bike to any of the locations within the network. Unfortunately, users often do not have access to helmets when picking up a bike from one of the locations, and the distributed nature of the locations makes it impractical to have manned kiosks at each of the locations to rent helmets to users.

SUMMARY OF THE DISCLOSURE

The present disclosure provides systems and methods for the dispensing and collection of objects in urban environments. More particularly, the disclosure provides systems and methods for dispensing and collecting helmets. The disclosure provides a self-sufficient, high-capacity, helmet dispensing system and a backend system for the management of the dispensing systems and the inventory stored therein.

According to one aspect of the disclosure, a system for helmet rentals includes a kiosk. The kiosk includes a compartment for storing helmets. The compartment can include a dispensing unit with one or more vertical rods. Each of the one or more vertical rods can be configured to hold a plurality of helmets in a vertical stacking arrangement. The kiosk can also include a release mechanism coupled to the one or more vertical rods to release one of the plurality of helmets. The release of a helmet can be responsive to a signal to release the helmet of the plurality of helmets. The kiosk can also include a drawer coupled with the housing of the kiosk. The drawer can be configured to receive the return of the helmet.

In some implementations, the dispensing unit can include at least three vertical rods. Each of the one or more vertical rods can hold at least six helmets. The kiosk can also include a communications module to transmit an indication that the dispensing unit released the one of the plurality of helmets. The communications module can also transmit an indication that the one of the plurality of helmets was placed in the drawer, an indication that a number of helmets stored in the dispensing unit fell below a predetermined threshold, or an indication that the number of returned helmets rose above a threshold.

The dispensing unit can include a quick release to release the one or more vertical rods from the dispensing unit. In some implementations, the kiosk includes one or more solar panels to power the system. The one of the plurality of helmets released can be released from a bottom of the vertical stacking arrangement. In some implementations, the kiosk includes an interface to receive a request from a bike sharing system to release the one of the plurality of helmets.

According to another aspect of the disclosure, a method of dispensing a helmet can include providing, by a kiosk, an interface to receive a request to dispense a helmet. The method can also include determining, by a controller, to dispense the helmet responsive to receiving a request at the kiosk. The method can also include transmitting, by the controller responsive to the determination, a signal to a dispensing unit to release the helmet. The dispensing unit can include one or more vertical rods configured to hold a plurality of helmets in a vertical stacking arrangement. The method may also include releasing, by a release mechanism within the dispensing unit, the helmet from the one or more vertical rods.

In some implementations, the dispensing unit includes at least three vertical rods. Each of the one or more vertical rods can be configured to hold at least six helmets. The method may also include transmitting, by a communications module, an indication that the helmet was released from the kiosk, an indication that the helmet was returned to the kiosk, an indication that a number of helmets stored in the dispensing unit is below a predetermined threshold, or an indication that a number of helmets returned to the kiosk is above a second threshold.

In some implementations, the method can include receiving, by a return system, the helmet. In some implementations, the kiosk is powered by one or more solar panels. The method can include replacing the one or more vertical rods with a second one or more vertical rods prefilled with helmets. In some implementations, the method includes receiving the request from a bike sharing system.

BRIEF DESCRIPTION OF THE DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The system and method may be better understood from the following illustrative description with reference to the following drawings in which.

DETAILED DESCRIPTION

The various concepts introduced above and discussed in greater detail below may be implemented in any of numerous ways, as the described concepts are not limited to any particular manner of implementation. Examples of specific implementations and applications are provided primarily for illustrative purposes.

For purposes of reading the description of the various embodiments below, the following descriptions of the sections of the specification and their respective contents may be helpful:

Section A describes embodiments of systems and methods for dispensing helmets with a helmet rental kiosk Section B describes a network environment and computing environment which may be useful for practicing embodiments described herein.

The disclosure presents systems and methods for dispensing and collecting helmets. Bike share programs are becoming more prevalent in metropolitan areas. Unfortunately, due to a user's spontaneous use of the bikes in the bike share program, users may rarely have access to a helmet when riding a bike share bike. The present disclosure presents systems that may be positioned at a bike share station. Users may check out a helmet from the system when renting a bike share bike. The users may then return the helmet at a later date. In general the system may include several subsystems. These subsystems may include a dispensing system, and return system, and a backend system.

A. Systems and Methods for Dispensing Helmets with a Helmet Rental Kiosk

Figure 1:
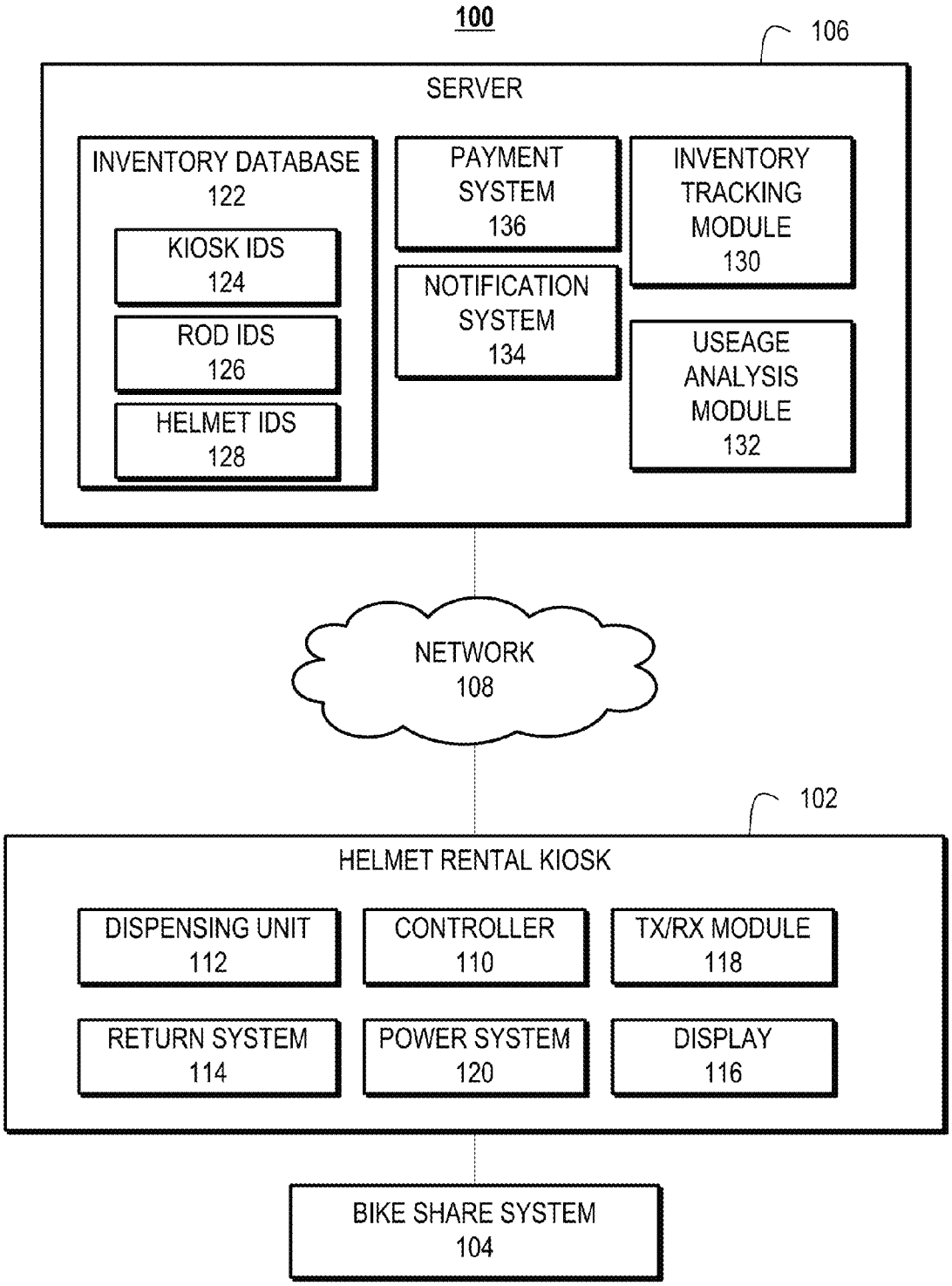
FIG. 1 is a block diagram of an example system for renting helmets, in accordance with an implementation of the present disclosure.

FIG. 1 is a block diagram of an example system 100 for renting helmets. As an overview, the system 100 can include a helmet rental kiosk 102 (or simply kiosk 102), which can be coupled with a bike share system 104. The kiosk 102 can communicate with a backend server 106 via a network 108. The controller 110 of the kiosk 102 can control the operation of the kiosk 102, such as the release of a helmet. The kiosk 102 can include a dispensing unit 112 to dispense helmets to users and a return system 114 where the user can return the helmet after use. The user may interact with the kiosk 102 through a display 116. The kiosk 102 can include a power system 120 that can be independent of city or external power systems. The kiosk 102 can also include a communications (TX/RX) module 118 that can enable the kiosk 102 to communicate with the backend server 106 and other devices.

The system 100 can also include a backend server 106. The backend server 106 can include an inventory database 122. The backend server 106 may track the use and availability of helmets by storing relevant information in the inventory database 122. The backend server 106 may store kiosk IDs 124, rod IDs 126, and helmet IDs 128. The inventory tracking module 130 may reference the data stored in the inventory database 122 to determine the inventory of the kiosk 102. The backend server 106 may also include a usage analysis module 132 and a notification system 134. The backend server 106 may also include a payment system 136 for processing the rental transactions. In some implementations, one or more of the components of the backend server 106 may be included as a component of the kiosk 102. For example, the one or more of the components of the backend server 106 may be a software application that is stored in a computer readable medium associated with the controller 110. The controller 110 may execute the application to perform the functions of the components.

Referring to FIG. 1 in greater detail, the system 100 can include a kiosk 102. The mechanics of the kiosk 102 are described below, but briefly, the kiosk 102 can include a plurality of subsystems to enable the rental of helmets. The kiosk 102 can include a controller 110. The controller 110 can include one or more processors that implement machine executable instructions to perform the methods described herein. The one or more processors may by any type of single or multi-core processor capable of executing machine readable instructions. For example, the controller 110 may be a computer or programmable processor. The controller 110 may include special purpose logic circuitry such as a field programmable gate array (FPGA) or an ASIC.

The kiosk 102 may also include a display 116. In some implementations, a user may interact with the kiosk 102 using the display 116. For example, the display 116 may be a touch screen or a display surrounded by a plurality of physical buttons. Using the buttons, whether physical or part of a graphical user interface (GUI), the user may select, pay for the rental of a helmet, and return the helmet. In some implementations, the display 116 can be used by a technician to determine how many helmets the kiosk 102 currently has available for rental or to view status information of the kiosk 102. For example, the display 116 may be used to display battery levels and maintenance needs to a technician. When not being actively used by a user to rent a helmet, the display 116 may display ads or other information. For example, the display 116 may display information about where other kiosks 102 can be found in town.

The kiosk 102 can also include a power system 120. The power system 120 can be configured to power the various components of the kiosk 102. In some implementations, the power system 120 is an AC power supply that receives electrical power from a mains supply or other outlet. The power system 120 may include a DC converter to convert the supplied AC power into DC power for the controller 110 and other components of the kiosk 102. In other implementations, the power system 120 can include one or more batteries that power the kiosk 102. The batteries may be used as a primary source of power or may be used as back up if the primary power source fails. The power system 120 may include one or more solar panels. In some embodiments, the solar panels may be placed on the top or sides of the kiosk 102. The solar panels may charge a set of batteries housed in the kiosk 102. The batteries may then power the various electronics of the kiosk 102. In some implementations, the solar panels may generate enough electricity to fully power the kiosk 102. The batteries charged by the solar panels may be configured to power the kiosk 102 independently for between 1 and 15 days (e.g., the batteries may power the kiosk 102 even after seven consecutive days of cloudy weather prevented the solar panels from generating a substantial amount of electricity). In some implementations, the power system 120 may be configured to include a plurality of power systems (e.g., solar and AC power) that can be selected based on predetermined conditions. For example, if the kiosk 102 is placed in a sunny park the kiosk 102 may run on energy gathered by the solar panels. In another example, the power system 120 may be placed near a building and have relatively easy access to AC power. In this example, the power system 120 may use AC power to power its systems.

The kiosk 102 can also include a communications module 118. The kiosk 102 can communicate with other devices and the server 106 through the communications module 118. The communications module 118 can enable the kiosk 102 to communicate with devices over the network 108 using wired or wireless communication protocols. For example, the communications module 118 enable the kiosk 102 to communicate with other devices over RS-232, phone lines, powerlines, Ethernet, WiFi, Bluetooth, WiMAX, 3G, 4G, cellular networks, or a combination thereof. In some implementations, costs of the kiosk 102 can be reduced by moving some systems from the kiosk 102 to the backend server 106—for example, the payment system 136 and the inventory tracking module 130. In this example, the kiosk 102 may not track its inventory, but relays an indication, via the communications module 118, of a rental to the backend server 106 each time a helmet is rented, and the backend server 106 maintains the inventory information for the kiosk 102. In some implementations, the communications module 118 may transmit indications of its real-time inventory to the server 106, such that a technician may view the kiosk's inventory. The kiosk 102 may also transmit indications of its stock of returned helmets or directly alert a technician when the number of returned helmets has reached (or rises above) a predetermined threshold so that the technician may remove the returned helmets from the kiosk 102 for cleaning. The kiosk 102 can also directly (or indirectly through the server) notify a technician if the inventory of helmets in the kiosk 102 drops below a predetermined level.

The kiosk 102 can also include a dispensing unit 112 and a return system 114. The dispensing unit 112 stores the helmets prior to the rental of the helmet. In some implementations, the dispensing unit 112 includes a plurality of rods on which the helmets are vertically stacked. When a user rents a helmet from the kiosk 102, the dispensing unit 112 releases one helmet from one of the plurality of rods. The user may return the helmet to the kiosk 102 via the return system 114. In some implementations, the return system 114 is a drawer or other return receptacle. In some implementations, the return system 114 can be configured to only accept helmets such that trash and other debris cannot enter the kiosk 102.

Still referring to FIG. 1, the system 100 can include a backend server. The backend server 106 can include an inventory database 122 for managing and tracking the inventory of the kiosk 102. Each of the kiosks 102 may be associated with a kiosk ID 124. Each kiosk ID 124 can be associated with a plurality of rod IDS 126, which in turn can each be associated with a plurality of helmet IDS 128. The data stored in the inventory database 122 can be maintained by the inventory tracking module 130. The inventory tracking module 130 can receive an indication from the kiosk 102 when a helmet is rented or returned. The indication may include the kiosk ID 124, a rod ID 126, a helmet ID 128, a user ID, a timestamp or any combination thereof. When a helmet is returned, the inventory tracking module 130 may receive an indication from the kiosk 102 and mark the corresponding helmet as returned.

The backend server 106 can also include a usage analysis module 132 that can track the usage of each kiosk 102. In some implementations, the usage analysis module 132 can generate usage reports. The usage reports can indicate kiosk 102 statistics, such as, how many helmets a specific kiosk 102 rents out over a given time period, how many helmets are currently available for rent in a given area, and which kiosk 102 generates the most business when compared to the other kiosks located in the same city. The usage analysis module 132 may also monitor the operation of the kiosk 102 and alert a technician if the usage analysis module 132 detects a fault with a kiosk 102. The usage analysis module 132, through the notification system 134, can send notifications when the inventory in a kiosk 102 (or when the combined inventory of a plurality of kiosks 102) falls below a predetermined number and needs to be refilled. In some implementations, the notifications generated by the notification system 134 can include an email, SMS, or push notification. The usage analysis module 132 may also track the use of helmets in the system 100. For example, the usage analysis module 132 may indicate the helmets should be removed from the system 100 after being used a predetermined number of times.

The backend server 106 can also include a payment system 136. The payment system 136 can handle the processing of credit cards and debit cards when a helmet is checked out from a kiosk 102. For example, a user may enter their credit card information at the display 116 of the kiosk 102. The information may be transmitted to the payment system 136 where it is processed and the user's account is debited. In some implementations, the user may purchase a monthly subscription to the system 100. For example, users may be able to create accounts associated with the kiosk 102. In some embodiments, the user may be able to associate a method of payment (e.g. a credit card) with the user's account such that the user's method of payment is automatically debited by the payment system 136 when the user rents a helmet. In this example, the user may input a user name or code via the display 116, which is transmitted back to the payment system 136. The payment system 136 may determine the validity of the user's subscription and, if valid, indicate to the kiosk 102 that the kiosk 102 should release a helmet to the user. In another implementation, the rental of the helmet may be included with the rental of a bike from a bike share system 104. In this example, the bike share system 104 may transmit an indication to the payment system 136 that the kiosk 102 should release a helmet to the user. The kiosk 102 may provide the bike share system 104 with an API that enables the bike share system 104 to communicate with the kiosk 102 or server 106. In some implementations, the bike share system 104 can interface with the controller 110 of the kiosk 102 to have the kiosk 102 release a helmet to the user without first sending the request to the payment system 136. In some implementations, if the user does not return a rented helmet at the predetermined time or if the helmet is returned damaged, the payment system 136 may charge a fee to the user's credit card. In some implementations, the payment system 136 debits the users account when the helmet is rented, and in other implementations the payment system debits the users account after the helmet is returned.

Figure 2A:
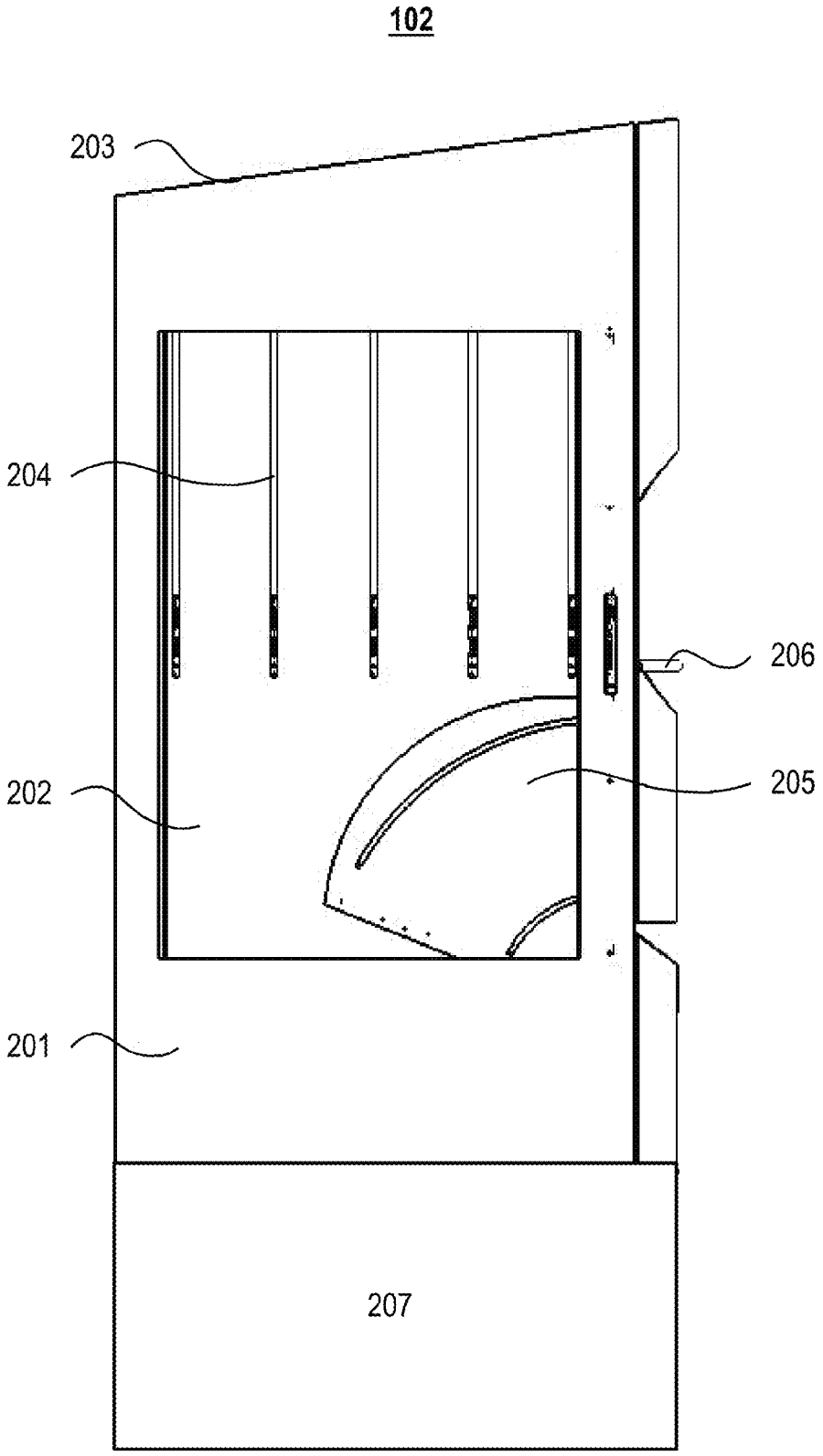
FIGS. 2A, 2B and 3 illustrate different views of an example embodiment of the kiosk for use in the system of FIG. 1, in accordance with an implementation of the present disclosure.
Figure 2B:
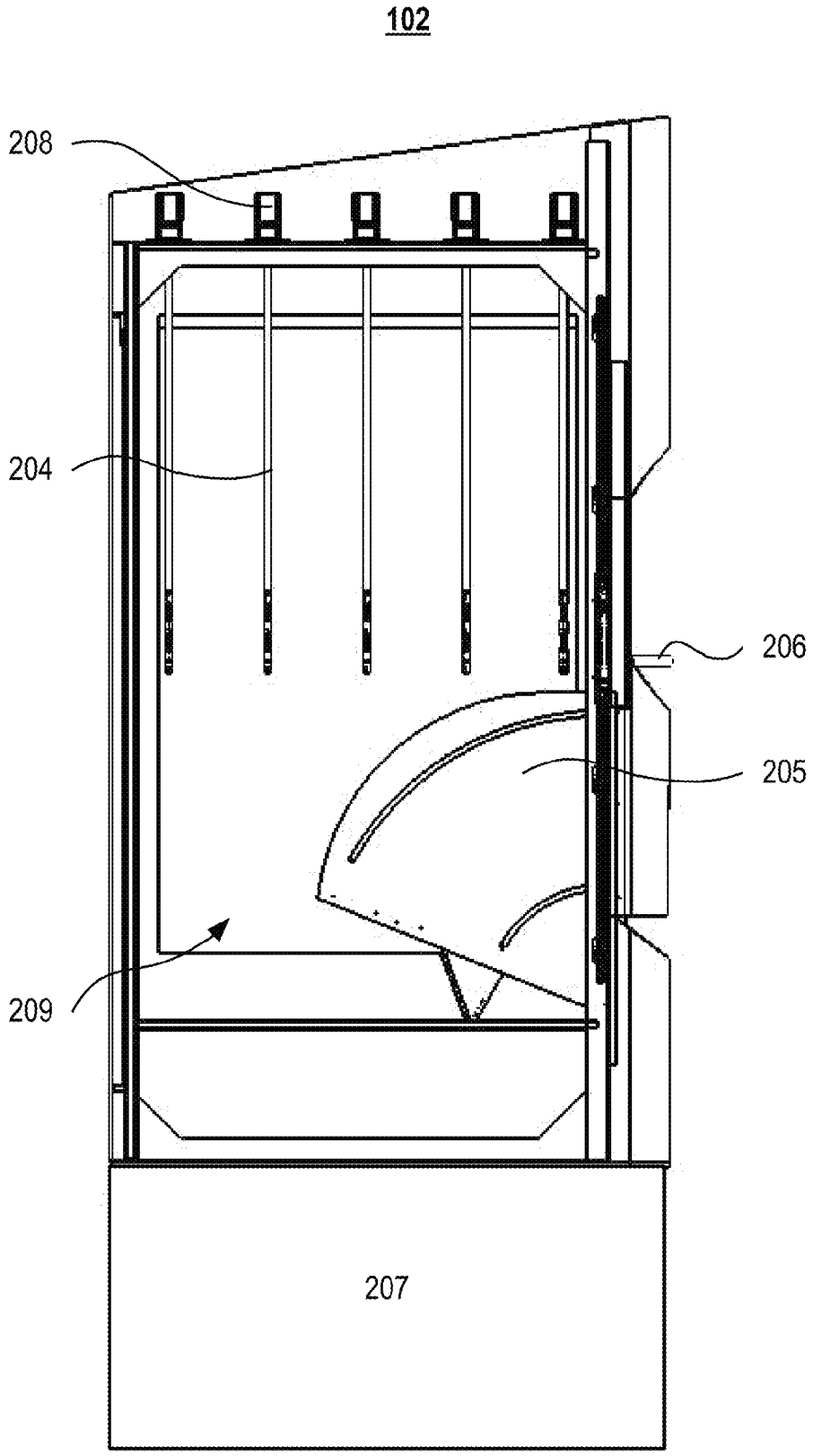

FIGS. 2A and 2B illustrate an example embodiment of the kiosk 102. The kiosk 102 stores, dispenses, and receives helmets. The exterior of the kiosk 102 may include a display panel 202 within each of the side doors 201. Power for the kiosk 102 may be supplied and/or augmented by a solar panel within the roof 203 of the kiosk 102. The kiosk 102 may house a plurality of vertical rods 204 (also referred to as rods 204) on which helmets may be vertically stacked. The helmets can be dispensed to a user after released from a rod 204 though a dispensing and return drawer 205. In some implementations, the kiosk 102 includes a drawer (or receptacle) for dispensing the helmets and a drawer (or receptacle) for receiving helmets. The user can open the return drawer 205 by pulling on the handle 206. The kiosk 102 may sit atop a base 207. FIG. 2B illustrates the same kiosk 102, but with a side door 201 removed to expose the interior of the kiosk 102. FIG. 2B illustrates that a quick release mechanism and a driver 208 is coupled to teach of the rods 204. In some implementations, the kiosk 102 can also a chute that directs a released helmet into the drawer 205.

Referring to FIG. 2A in greater detail, the kiosk 102 can include a plurality of display panels 202. For example, the kiosk 102 may include a display panel 202 on the front, back, and two sides. The display panel 202 may be used to display information to users, such as pricing information. The display panel 202 may be used to attract potential customers. The display panel 202 may house a printed poster or decal. For example, the display panel 202 may be used to display ads for which the owner of the kiosk 102 receives revenue. In other embodiments, the display panel 202 may be used to display information such as locations in town where additional kiosk 102 are placed, a map indicating places of interest, and/or a map indicating roads with biking lanes. In other embodiments, one or more of the display panel 202 may be LCD screens.

The kiosk 102 can also include a base 207. The base 207 may be a support platform that positions the display panel 202 at a comfortable viewing height for the user. In some implementations, the base 207 may be made taller or shorter to accommodate smaller or larger kiosks 102. For example, the body of a first kiosk may be taller to accommodate more helmets. The base 207 for this first example kiosk may be shorter such that the display panel 202 remains at an appropriate viewing height for the user and such that the overall height of the kiosk 102 is not too high. As described above, the kiosk 102 may include a set of batteries to power the kiosk 102. In some implementations, the set of batteries may be stored in the base 207. In some embodiments, the base 207 may include storage for the returned helmets. Counter weights may be stored in the base 207 to ensure the kiosk 102 is not top heavy. In some implementations, the set of batteries may act as the counter weights. The base 207 may be secured to a sidewalk or other physical structure such that the kiosk 102 cannot be stolen or improperly moved. In some implementations, the base 207 can be configured to couple with a bike share system kiosk.

The kiosk 102 can also include a plurality of vertical rods 204. The rods 204 can each store a plurality of helmets in a vertical stacking arrangement. The vertical stacking arrangement can be an efficient packing arrangement of the helmets that enables the kiosk 102 to store a large number of helmets. Each rod 204 is part of the dispensing unit of the kiosk 102. The dispensing unit can hold between 3 and 15 rods 204 in compartment 209, depending on the capacity needs of the kiosk 102. The kiosk 102 illustrated in FIG. 2A is configured to hold 5 rods 204. Each rod 204 includes a release mechanism that is configured to release one helmet at a time. In some implementations, the capacity of the kiosk can be increased by adding additional rods 204 and/or by elongating the rods 204 such that they may hold more helmets. In some implementations, the size of the compartment 209 is increased to accommodate more or longer rods 204. The helmets are vertically stacked on the rods 204 by sliding the rods 204 through a vent hole in each of the helmets. In a vertical stacking arrangement, the helmet on the bottom of the stack is held in place by the release mechanism. The other helmets sit atop (e.g., are stacked on) the helmet immediately below the particular helmet in the vertical arrangement. When the helmet at the bottom of the stack is released each of the helmets in the vertical arrangement fall down one slot and the helmet now at the bottom of the rod 204 is caught and held in place by the release mechanism. In some implementations, each of the rods 204 are configured to hold between 5 and 15 helmets.

The kiosk 102 can also include a dispensing and return drawer 205. The drawer 205 may be designed to accept the helmets associated with the kiosk 102 but make it difficult to place items other than the approved helmets into the drawer 205. For example, the drawer 205 may be designed with a grated bottom such that trash and other debris cannot easily be placed in the drawer 205. In some embodiments, drawer 205 may be configured such that a helmet must be positioned in a predetermined manner to be accepted by the drawer 205. For example, the drawer 205 may be configured such that a helmet must be placed right side up and facing forward before it can be placed in the drawer 205. Aligning the helmet in a predetermined fashion in the return drawer 205 may facilitate the return process in some implementations. In some implementations, the drawer 205 may be configured for both the dispensing and return of helmets. In other implementations, the kiosk 102 may include a first drawer for dispensing helmets and a second drawer for the return of helmets.

FIG. 2B illustrates the interior of the kiosk 102. Each of the rods 204 can be coupled to a quick release mechanism 208. The quick release mechanism 208 can include the actuator that drives the release mechanism in each of the rods 204. The actuator can be a motor, servo, solenoid valve, or other transducer capable of driving the release mechanism. In some embodiments, the rods 204 are reversibly coupled to the quick release mechanism 208. The rods 204 may be reversibly coupled to the quick release mechanism 208 such that a technician may quickly remove the rods 204 from the kiosk 102. In this example, the kiosk 102 may be "refilled" by decoupling a rod 204 and replacing the rod 204 with a new rod 204, preloaded with helmets. This may enable a technician to arrive at the kiosk 102, open one of the side doors 201, and quickly refill the kiosk 102 with prefilled rods 204. In other implementations, the rods 204 may be permanently coupled to the quick release mechanism 208 and the kiosk 102 may be refilled by sliding helmets onto each of the rods 204, while the technical is at the kiosk 102.

Figure 3:
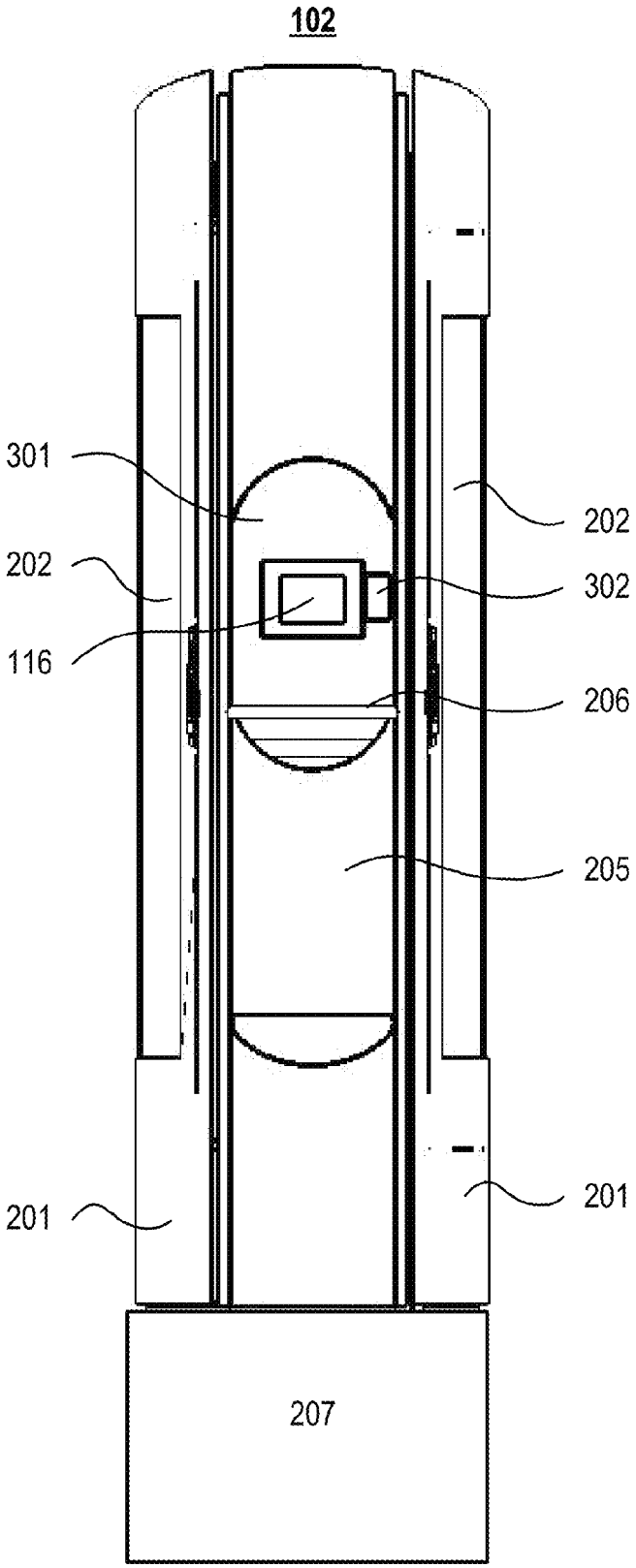

FIG. 3 illustrates a front view of the example kiosk 102. The front view of the kiosk 102 reveals a transaction panel 301, which includes the display 116 and a credit card reader 302. The transaction panel 301 may include a plurality of buttons that allow a user to interact with the kiosk 102. Example interactions a user can have with the kiosk 102 via the transaction panel 301 may include, but are not limited to, checking in a helmet, checking out a helmet, checking the availability of helmets, and finding other locations where the user may check in/out a helmet.

The transaction panel 301 may also include the credit card reader 302. In some embodiments, the credit card reader 302 may be configured to read any type of magnetic stripped card—for example a credit card or a membership card associated with the kiosk 102. The transaction panel 301 may also include a radio-frequency identification (RFID) module (not pictured). The RFID module may allow users may check out (or in) helmets from the kiosk 102 by using an RFID enabled card or fob. The electronics of the transaction panel 301 may also house the controller 110 and the communications module 118 for the kiosk 102.

Figure 4:
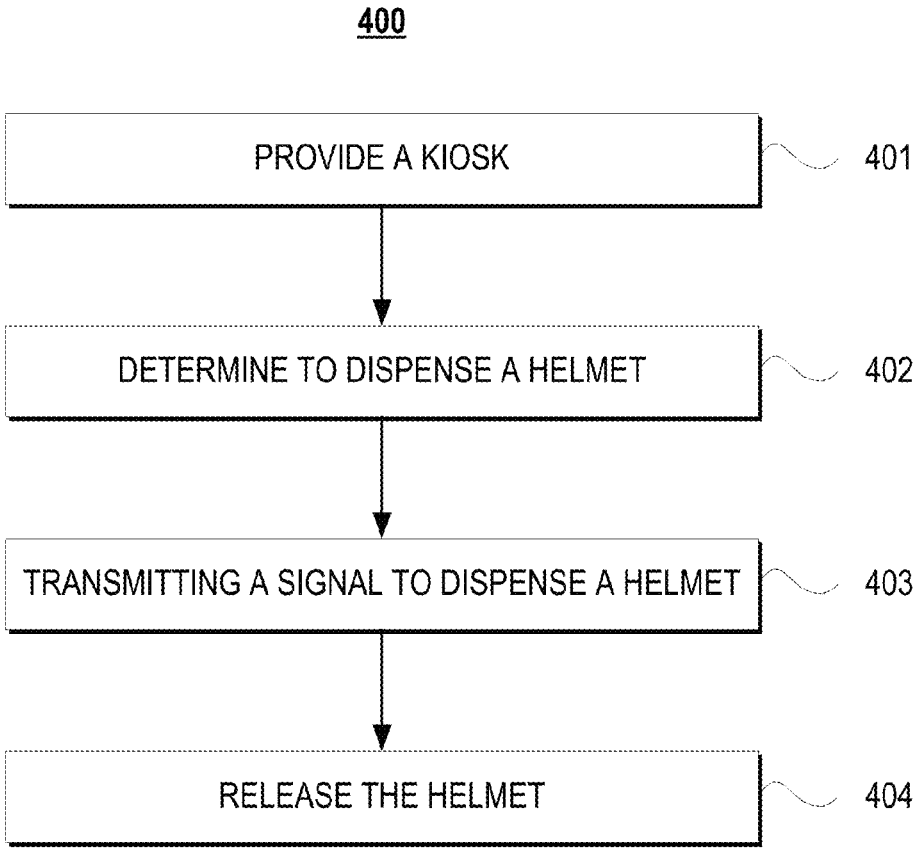
FIG. 4 illustrates a flow diagram of an example method for dispensing a helmet from a helmet rental kiosk, in accordance with an implementation of the present disclosure.

FIG. 4 illustrates a flow diagram of an example method 400 for dispensing a helmet from a helmet rental kiosk. The method 400 can include providing a kiosk (step 401). A determination is made to dispense a helmet (step 402). A signal can then be transmitted to the dispensing system of the kiosk to release the helmet (step 403). Responsive to receiving the signal, the dispensing system releases the helmet (step 404).

As set for the above, the method 400 can include providing a kiosk (step 401). The kiosk can be similar to the above described kiosk 102 in FIGS. 1-3. The kiosk can include an interface to receive a request for a helmet. The interface can be part of the above described transaction panel 301 with a display 116 where the user can enter a request for a helmet. In some implementations, the request may be received from a bike share program. For example, a user may rent a bike from a bike share program. When renting the bike, the bike share program kiosk may ask the user if the user would also like to include the rental of a helmet. If the user decides to also rent a helmet, the bike share program may send a request to the kiosk to initial a helmet rental. In another example, a user may request a helmet from the kiosk using a mobile phone. For example, when at the kiosk, the user may visit a webpage associated with the kiosk on the user's mobile phone. Using the website, the user may request a helmet. As described above, the helmet can store a plurality of helmets for rental and also receive helmets after the rental period is over. The helmets may be stored in a vertical arrangement on one or more rods within the dispensing system.

At step 402, the kiosk can determine to dispense the helmet. The determination to dispense a helmet may be made in response to receiving the request in step 401. In some implementations, the determination is made responsive to an authorization. For example, the user may be a member of a subscription service that allows the user to rent a predetermined number of helmets each month. At a kiosk, the user may request a helmet, the controller of the kiosk may check with the server to determine if the user's subscription is still active before dispensing the helmet. In another example, the authorization may be given responsive to the successful charging of a user's payment system (e.g., credit card) by the payment system 136.

At step 403, the controller of the kiosk may then transmit a signal to release a helmet. Responsive to determining that a helmet should be released, the controller can send a signal to the dispensing unit that then controls the release mechanism of a rod to release a helmet. The signal may be an electrical signal that activates, or causes the activation, of a release mechanism in one of the rods. For example, the signal may be an electrical signal that throws a relay, powering a solenoid coupled with the release mechanism. In other implementations, the signal may be an electrical signal that includes digital information such as from which rod the helmet may be released. The signal may be received by a controller in the dispensing unit that interprets the digital information in the signal and activates a release mechanism as instructed by the signal. In some implementations, the signal to release a helmet may arrive at the release mechanism, having originated with a server or bike share program. For example the kiosk may have an API that enables a bike share program to interface with and control the kiosk.

At step 404, the kiosk may then release the helmet to the user. The signal may trigger a release mechanism of one of the rods to release a helmet. In some implementations, the rods include a staging area where the helmets are placed prior to release. In some implementations, the helmet may include an RFID chip that can be scanned by the dispensing unit to enable the kiosk to track and inventory the helmet. In other implementations, the kiosk may determine which helmet was released by knowing the order of the helmets on each of the rods. For example, kiosk may know that rod A contains helmets 1-4, with helmet 4 being on the bottom of the vertically stacked arrangement. Accordingly, when the next helmet is released from rod A, the kiosk will know that it is helmet 4 that is released.

In some implementations, the method 400 can also include the kiosk transmitting, via the communications module, an indication to the server that the helmet was successfully released. Responsive to this indication the server may remove the released helmet from the kiosk's inventory. The kiosk may also notify the server when a helmet is returned to the kiosk. Upon a predetermined number of helmets have been rented (or the kiosk or server determines the kiosk's inventory is low) a notification may be sent from the server to a technician that the kiosk's inventory is low and that the kiosk should be refilled with helmets. The method may also include the server or kiosk notifying a technician that the kiosk's return system is becoming full and should be emptied so the kiosk may continue to accept helmets.

The method 400 may also include receiving the helmet from a user. When a user returns a helmet, the user may check the helmet into the kiosk using the display of the transaction panel. In other implementations, the helmet may be automatically checked into the kiosk when the user places the helmet in the return drawer. The screen may notify the user of the length of time the helmet was rented and the cost for having rented the helmet. Responsive to a user returning the helmet the kiosk may print the user a receipt with an internal receipt printer. In some embodiments, the kiosk may email the user a receipt via its communications module and the server.

The method 400 can also include checking the structural integrity of the helmet. In some embodiments, checking the integrity of the helmets may be automated and/or done by human inspection. In some embodiments, the automated system may use non-destructive testing to determine if the helmet is structurally sound and/or damaged. The non-destructive testing methods may include at least one of resonance testing and computer vision analyses in both the visual and non-visual spectrum (e.g., infrared and x-ray). For example, the automated system may include a system that photographs the helmets and uses computer vision to find cracks, scuffs and/or vandalism. In some embodiment, the system may send the helmet for human inspection if the automated system detects a fault in the helmet.

The method 400 can also include cleaning the helmet. In some embodiments, the helmets may be heat sterilized. In other embodiments, the helmets may be sterilized with an ethylene oxide sterilizer. In some embodiments, the helmets are sanitized with disinfectants such as, but not limited to, antimicrobial agents, alcohols, and other cleaning agents. In some implementations, the check of the helmet's structural integrity or the cleaning of the helmet may be conducted onsite and automatically by the kiosk 102.

B. Computing and Network Environment

Figure 5A:
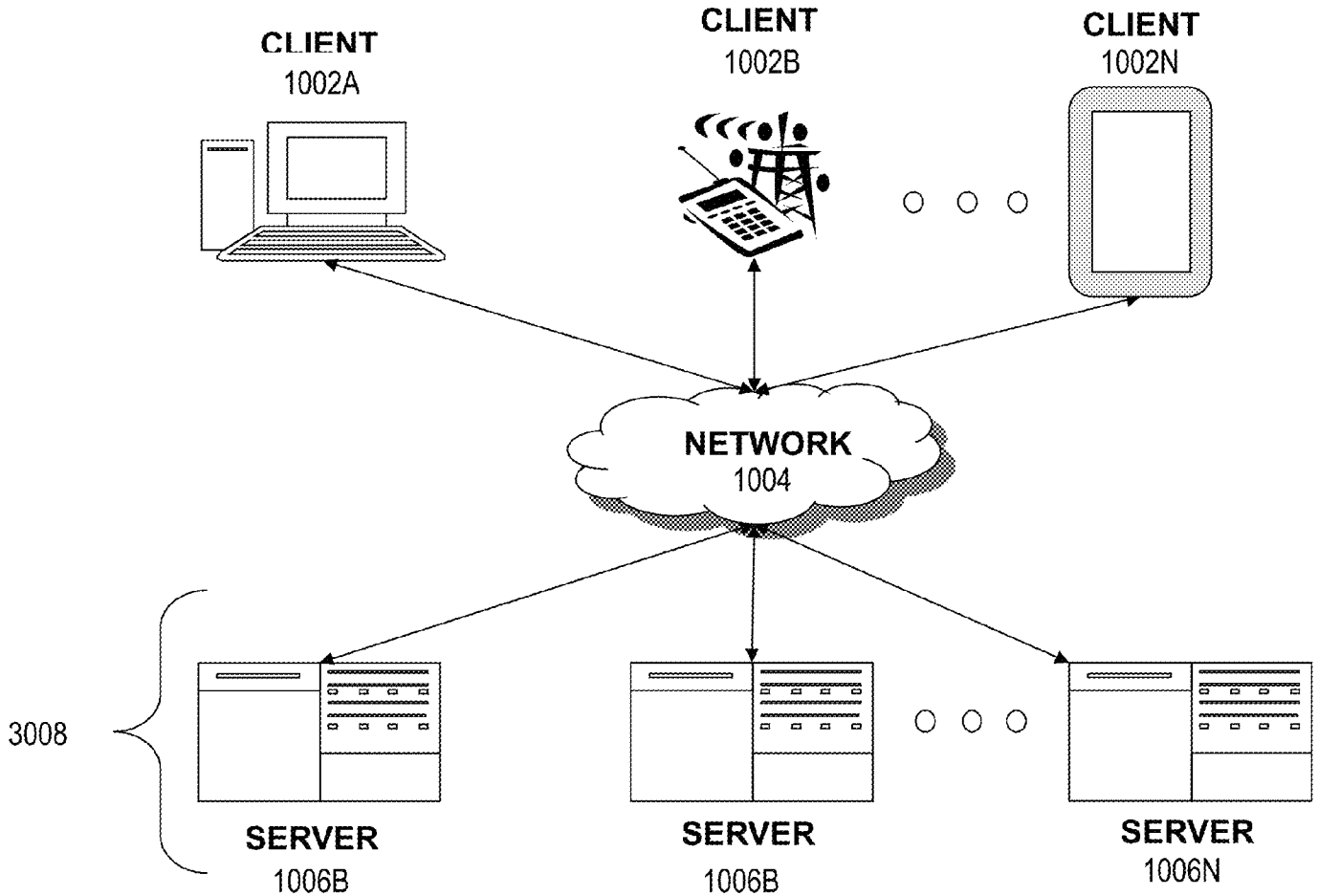
FIG. 5A is a block diagram depicting an embodiment of a network environment comprising client device in communication with server device.

Prior to discussing specific embodiments of the present solution, it may be helpful to describe aspects of the operating environment as well as associated system components (e.g., hardware elements) in connection with the methods and systems described herein. Referring to FIG. 5A, an embodiment of a network environment is depicted. In brief overview, the network environment includes one or more clients 10002*a*-10002*n* (also generally referred to as local machine(s) 10002, client(s) 10002, client node(s) 10002, client machine(s) 10002, client computer(s) 10002, client device(s) 10002, endpoint(s) 10002, or endpoint node(s) 1002) in communication with one or more servers 1006*a*-1006*n* (also generally referred to as server(s) 1006, node 1006, or remote machine(s) 1006) via one or more networks 1004. In some embodiments, a client 1002 has the capacity to function as both a client node seeking access to resources provided by a server and as a server providing access to hosted resources for other clients 1002*a*-1002*n*.

Although FIG. 5A shows a network 1004 between the clients 1002 and the servers 1006, the clients 1002 and the servers 1006 may be on the same network 1004. In some embodiments, there are multiple networks 1004 between the clients 1002 and the servers 1006. In one of these embodiments, a network 1004' (not shown) may be a private network and a network 1004 may be a public network. In another of these embodiments, a network 1004 may be a private network and a network 1004' a public network. In still another of these embodiments, networks 1004 and 1004' may both be private networks.

The network 1004 may be connected via wired or wireless links Wired links may include Digital Subscriber Line (DSL), coaxial cable lines, or optical fiber lines. The wireless links may include BLUETOOTH, Wi-Fi, Worldwide Interoperability for Microwave Access (WiMAX), an infrared channel or satellite band. The wireless links may also include any cellular network standards used to communicate among mobile devices, including standards that qualify as 1G, 2G, 3G, or 4G. The network standards may qualify as one or more generation of mobile telecommunication standards by fulfilling a specification or standards such as the specifications maintained by International Telecommunication Union. The 3G standards, for example, may correspond to the International Mobile Telecommunications-2000 (IMT-2000) specification, and the 4G standards may correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards may use various channel access methods e.g. FDMA, TDMA, CDMA, or SDMA. In some embodiments, different types of data may be transmitted via different links and standards. In other embodiments, the same types of data may be transmitted via different links and standards.

The network 1004 may be any type and/or form of network. The geographical scope of the network 1004 may vary widely and the network 1004 can be a body area network (BAN), a personal area network (PAN), a local-area network (LAN), e.g. Intranet, a metropolitan area network (MAN), a wide area network (WAN), or the Internet. The topology of the network 1004 may be of any form and may include, e.g., any of the following: point-to-point, bus, star, ring, mesh, or tree. The network 1004 may be an overlay network which is virtual and sits on top of one or more layers of other networks 1004'. The network 1004 may be of any such network topology as known to those ordinarily skilled in the art capable of supporting the operations described herein. The network 1004 may utilize different techniques and layers or stacks of protocols, including, e.g., the Ethernet protocol, the internet protocol suite (TCP/IP), the ATM (Asynchronous Transfer Mode) technique, the SONET (Synchronous Optical Networking) protocol, or the SDH (Synchronous Digital Hierarchy) protocol. The TCP/IP internet protocol suite may include application layer, transport layer, internet layer (including, e.g., IPv6), or the link layer. The network 1004 may be a type of a broadcast network, a telecommunications network, a data communication network, or a computer network.

In some embodiments, the system may include multiple, logically-grouped servers 1006. In one of these embodiments, the logical group of servers may be referred to as a server farm 3008 or a machine farm 3008. In another of these embodiments, the servers 1006 may be geographically dispersed. In other embodiments, a machine farm 3008 may be administered as a single entity. In still other embodiments, the machine farm 3008 includes a plurality of machine farms 3008. The servers 1006 within each machine farm 3008 can be heterogeneous—one or more of the servers 1006 or machines 1006 can operate according to one type of operating system platform (e.g., WINDOWS NT, manufactured by Microsoft Corp. of Redmond, Wash.), while one or more of the other servers 1006 can operate on according to another type of operating system platform (e.g., Unix, Linux, or Mac OS X).

In one embodiment, servers 1006 in the machine farm 3008 may be stored in high-density rack systems, along with associated storage systems, and located in an enterprise data center. In this embodiment, consolidating the servers 1006 in this way may improve system manageability, data security, the physical security of the system, and system performance by locating servers 1006 and high performance storage systems on localized high performance networks. Centralizing the servers 1006 and storage systems and coupling them with advanced system management tools allows more efficient use of server resources.

The servers 1006 of each machine farm 3008 do not need to be physically proximate to another server 1006 in the same machine farm 3008. Thus, the group of servers 1006 logically grouped as a machine farm 3008 may be interconnected using a wide-area network (WAN) connection or a metropolitan-area network (MAN) connection. For example, a machine farm 3008 may include servers 1006 physically located in different continents or different regions of a continent, country, state, city, campus, or room. Data transmission speeds between servers 1006 in the machine farm 3008 can be increased if the servers 1006 are connected using a local-area network (LAN) connection or some form of direct connection. Additionally, a heterogeneous machine farm 3008 may include one or more servers 1006 operating according to a type of operating system, while one or more other servers 1006 execute one or more types of hypervisors rather than operating systems. In these embodiments, hypervisors may be used to emulate virtual hardware, partition physical hardware, virtualize physical hardware, and execute virtual machines that provide access to computing environments, allowing multiple operating systems to run concurrently on a host computer. Native hypervisors may run directly on the host computer.

Hypervisors may include VMware ESX/ESXi, manufactured by VMWare, Inc., of Palo Alto, Calif.; the Xen hypervisor, an open source product whose development is overseen by Citrix Systems, Inc.; the HYPER-V hypervisors provided by Microsoft or others. Hosted hypervisors may run within an operating system on a second software level. Examples of hosted hypervisors may include VMware Workstation and VIRTUALBOX.

Management of the machine farm 3008 may be de-centralized. For example, one or more servers 1006 may comprise components, subsystems and modules to support one or more management services for the machine farm 3008. In one of these embodiments, one or more servers 1006 provide functionality for management of dynamic data, including techniques for handling failover, data replication, and increasing the robustness of the machine farm 3008. Each server 1006 may communicate with a persistent store and, in some embodiments, with a dynamic store.

Server 1006 may be a file server, application server, web server, proxy server, appliance, network appliance, gateway, gateway server, virtualization server, deployment server, SSL VPN server, or firewall. In one embodiment, the server 1006 may be referred to as a remote machine or a node. In another embodiment, a plurality of nodes 290 may be in the path between any two communicating servers.

Figure 5B:
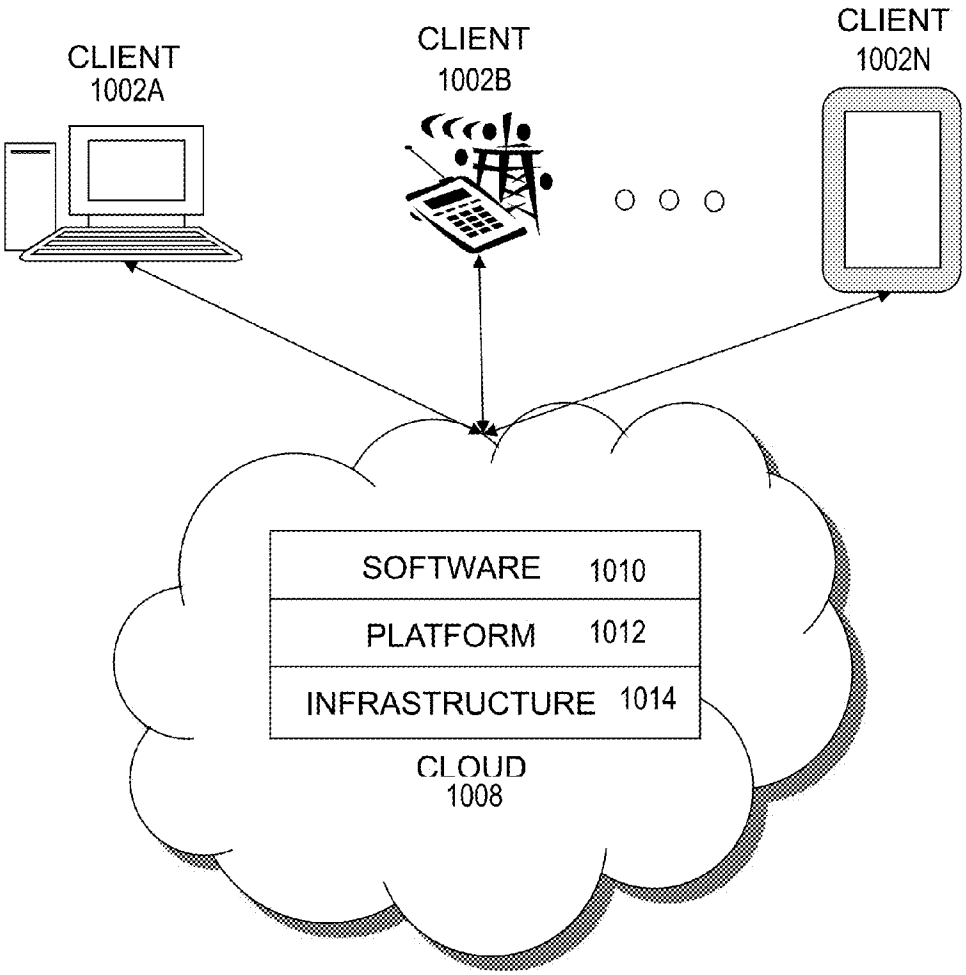
FIG. 5B is a block diagram depicting a cloud computing environment comprising client device in communication with cloud service providers.

Referring to FIG. 5B, a cloud computing environment is depicted. A cloud computing environment may provide client 1002 with one or more resources provided by a network environment. The cloud computing environment may include one or more clients 1002*a*-1002*n*, in communication with the cloud 1008 over one or more networks 1004. Clients 1002 may include, e.g., thick clients, thin clients, and zero clients. A thick client may provide at least some functionality even when disconnected from the cloud 1008 or servers 1006. A thin client or a zero client may depend on the connection to the cloud 1008 or server 1006 to provide functionality. A zero client may depend on the cloud 1008 or other networks 1004 or servers 1006 to retrieve operating system data for the client device. The cloud 1008 may include back end platforms, e.g., servers 1006, storage, server farms or data centers.

The cloud 1008 may be public, private, or hybrid. Public clouds may include public servers 1006 that are maintained by third parties to the clients 1002 or the owners of the clients. The servers 1006 may be located off-site in remote geographical locations as disclosed above or otherwise. Public clouds may be connected to the servers 1006 over a public network. Private clouds may include private servers 1006 that are physically maintained by clients 1002 or owners of clients.

Private clouds may be connected to the servers 1006 over a private network 1004. Hybrid clouds 1008 may include both the private and public networks 1004 and servers 1006.

The cloud 1008 may also include a cloud based delivery, e.g. Software as a Service (SaaS) 1010, Platform as a Service (PaaS) 1012, and Infrastructure as a Service (IaaS) 1014. IaaS may refer to a user renting the use of infrastructure resources that are needed during a specified time period.

IaaS providers may offer storage, networking, servers or virtualization resources from large pools, allowing the users to quickly scale up by accessing more resources as needed. Examples of IaaS include AMAZON WEB SERVICES provided by Amazon.com, Inc., of Seattle, Wash., RACKSPACE CLOUD provided by Rackspace US, Inc., of San Antonio, Tex., Google Compute Engine provided by Google Inc. of Mountain View, Calif., or RIGHTSCALE provided by RightScale, Inc., of Santa Barbara, Calif. PaaS providers may offer functionality provided by IaaS, including, e.g., storage, networking, servers or virtualization, as well as additional resources such as, e.g., the operating system, middleware, or runtime resources. Examples of PaaS include WINDOWS AZURE provided by Microsoft Corporation of Redmond, Wash., Google App Engine provided by Google Inc., and HEROKU provided by Heroku, Inc. of San Francisco, Calif. SaaS providers may offer the resources that PaaS provides, including storage, networking, servers, virtualization, operating system, middleware, or runtime resources. In some embodiments, SaaS providers may offer additional resources including, e.g., data and application resources. Examples of SaaS include GOOGLE APPS provided by Google Inc., SALESFORCE provided by Salesforce.com Inc. of San Francisco, Calif., or OFFICE 365 provided by Microsoft Corporation. Examples of SaaS may also include data storage providers, e.g. DROPBOX provided by Dropbox, Inc. of San Francisco, Calif., Microsoft SKYDRIVE provided by Microsoft Corporation, Google Drive provided by Google Inc., or Apple ICLOUD provided by Apple Inc. of Cupertino, Calif.

Clients 1002 may access IaaS resources with one or more IaaS standards, including, e.g., Amazon Elastic Compute Cloud (EC2), Open Cloud Computing Interface (OCCI), Cloud Infrastructure Management Interface (CIMI), or OpenStack standards. Some IaaS standards may allow clients access to resources over HTTP, and may use Representational State Transfer (REST) protocol or Simple Object Access Protocol (SOAP). Clients 1002 may access PaaS resources with different PaaS interfaces. Some PaaS interfaces use HTTP packages, standard Java APIs, JavaMail API, Java Data Objects (JDO), Java Persistence API (JPA), Python APIs, web integration APIs for different programming languages including, e.g., Rack for Ruby, WSGI for Python, or PSGI for Perl, or other APIs that may be built on REST, HTTP, XML, or other protocols. Clients 1002 may access SaaS resources through the use of web-based user interfaces, provided by a web browser (e.g. GOOGLE CHROME, Microsoft INTERNET EXPLORER, or Mozilla Firefox provided by Mozilla Foundation of Mountain View, Calif.). Clients 1002 may also access SaaS resources through smartphone or tablet applications, including, e.g., Salesforce Sales Cloud, or Google Drive app. Clients 1002 may also access SaaS resources through the client operating system, including, e.g., Windows file system for DROPBOX.

In some embodiments, access to IaaS, PaaS, or SaaS resources may be authenticated. For example, a server or authentication server may authenticate a user via security certificates, HTTPS, or API keys. API keys may include various encryption standards such as, e.g., Advanced Encryption Standard (AES). Data resources may be sent over Transport Layer Security (TLS) or Secure Sockets Layer (SSL).

Figure 5C:
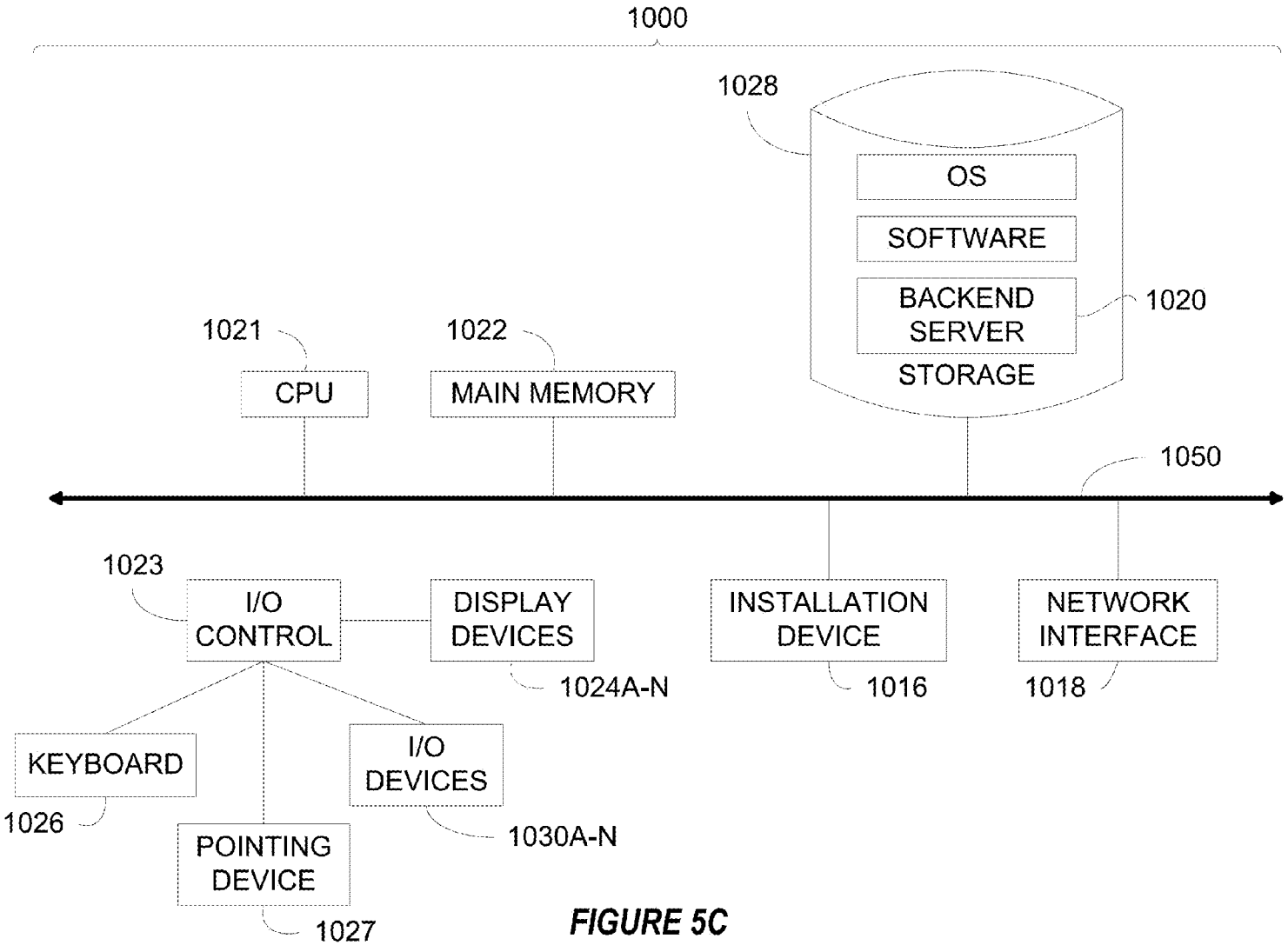
FIGS. 5C and 5D are block diagrams depicting embodiments of computing devices useful in connection with the methods and systems described herein.
Figure 5D:
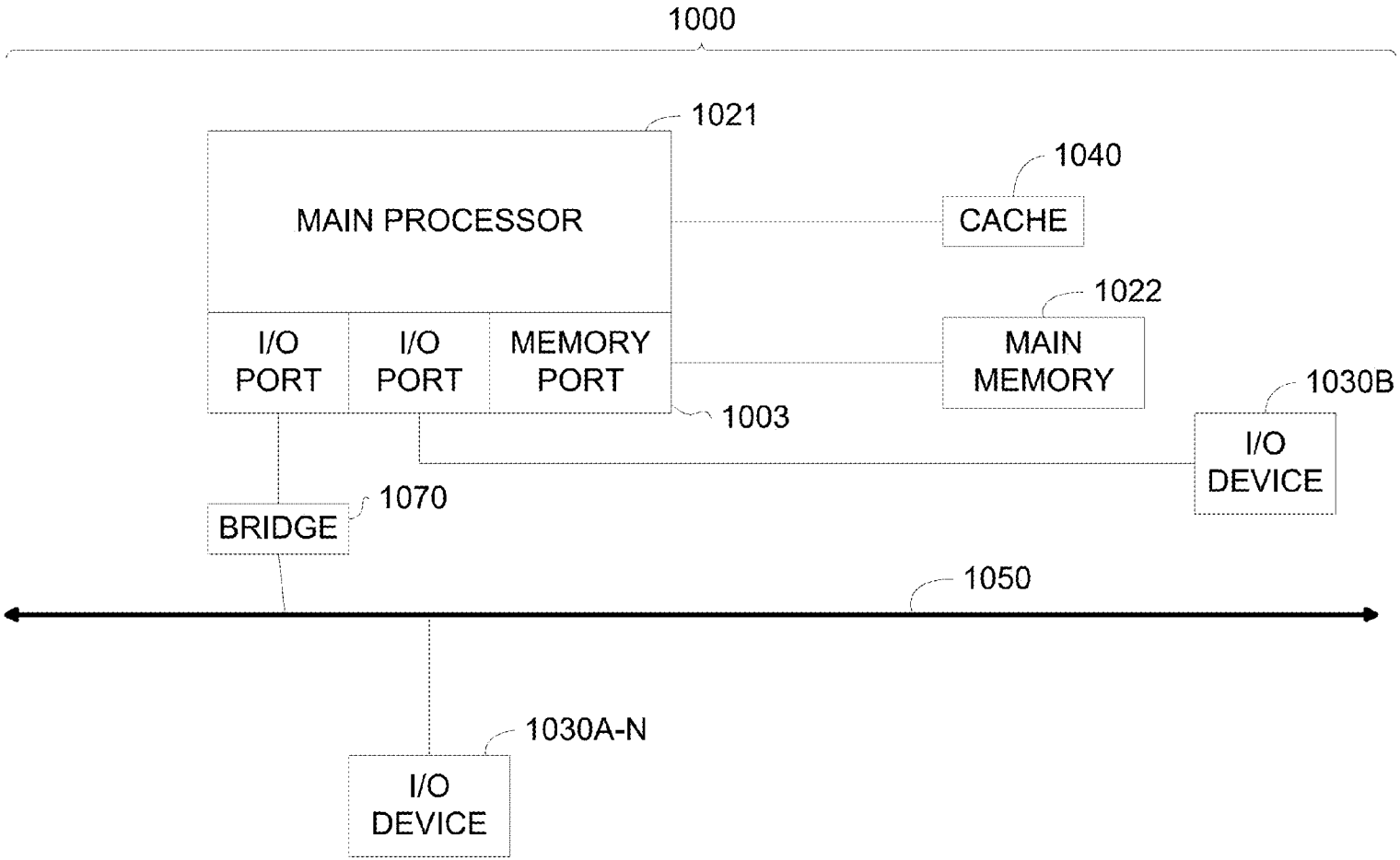

The client 1002 and server 1006 may be deployed as and/or executed on any type and form of computing device, e.g. a computer, network device or appliance capable of communicating on any type and form of network and performing the operations described herein. FIGS. 5C and 5D depict block diagrams of a computing device 1000 useful for practicing an embodiment of the client 1002 or a server 1006. As shown in FIGS. 5C and 5D, each computing device 1000 includes a central processing unit 1021, and a main memory unit 1022. As shown in FIG. 5C, a computing device 1000 may include a storage device 1028, an installation device 1016, a network interface 1018, an I/O controller 1023, display devices 1024*a*-1024*n*, a keyboard 1026 and a pointing device 1027, e.g. a mouse. The storage device 1028 may include, without limitation, an operating system, software, and software 1020 for the backend server of a helmet rental kiosk. As shown in FIG. 5D, each computing device 1000 may also include additional optional elements, e.g. a memory port 1003, a bridge 1070, one or more input/output devices 1030*a*-1030*n* (generally referred to using reference numeral 1030), and a cache memory 1040 in communication with the central processing unit 1021.

The central processing unit 1021 is any logic circuitry that responds to and processes instructions fetched from the main memory unit 1022. In many embodiments, the central processing unit 1021 is provided by a microprocessor unit, e.g.: those manufactured by Intel Corporation of Mountain View, Calif.; those manufactured by Motorola Corporation of Schaumburg, Ill.; the ARM processor and TEGRA system on a chip (SoC) manufactured by Nvidia of Santa Clara, Calif.; the POWER7 processor, those manufactured by International Business Machines of White Plains, N.Y.; or those manufactured by Advanced Micro Devices of Sunnyvale, Calif. The computing device 1000 may be based on any of these processors, or any other processor capable of operating as described herein. The central processing unit 1021 may utilize instruction level parallelism, thread level parallelism, different levels of cache, and multi-core processors. A multi-core processor may include two or more processing units on a single computing component. Examples of a multi-core processors include the AMD PHENOM IIX2, INTEL CORE i5 and INTEL CORE i7.

Main memory unit 1022 may include one or more memory chips capable of storing data and allowing any storage location to be directly accessed by the microprocessor 1021. Main memory unit 1022 may be volatile and faster than storage 1028 memory. Main memory units 1022 may be Dynamic random access memory (DRAM) or any variants, including static random access memory (SRAM), Burst SRAM or SynchBurst SRAM (BSRAM), Fast Page Mode DRAM (FPM DRAM), Enhanced DRAM (EDRAM), Extended Data Output RAM (EDO RAM), Extended Data Output DRAM (EDO DRAM), Burst Extended Data Output DRAM (BEDO DRAM), Single Data Rate Synchronous DRAM (SDR SDRAM), Double Data Rate SDRAM (DDR SDRAM), Direct Rambus DRAM (DRDRAM), or Extreme Data Rate DRAM (XDR DRAM). In some embodiments, the main memory 1022 or the storage 1028 may be non-volatile; e.g., non-volatile read access memory (NVRAM), flash memory non-volatile static RAM (nvSRAM), Ferroelectric RAM (FeRAM), Magnetoresistive RAM (MRAM), Phase-change memory (PRAM), conductive-bridging RAM (CBRAM), Silicon-Oxide-Nitride-Oxide-Silicon (SONOS), Resistive RAM (RRAM), Racetrack, Nano-RAM (NRAM), or Millipede memory. The main memory 1022 may be based on any of the above described memory chips, or any other available memory chips capable of operating as described herein. In the embodiment shown in FIG. 5C, the processor 1021 communicates with main memory 1022 via a system bus 1050 (described in more detail below). FIG. 5D depicts an embodiment of a computing device 1000 in which the processor communicates directly with main memory 1022 via a memory port 1003. For example, in FIG. 5D the main memory 1022 may be DRDRAM.

FIG. 5D depicts an embodiment in which the main processor 1021 communicates directly with cache memory 1040 via a secondary bus, sometimes referred to as a backside bus. In other embodiments, the main processor 1021 communicates with cache memory 1040 using the system bus 1050. Cache memory 1040 typically has a faster response time than main memory 1022 and is typically provided by SRAM, BSRAM, or EDRAM. In the embodiment shown in FIG. 5D, the processor 1021 communicates with various I/O devices 1030 via a local system bus 1050. Various buses may be used to connect the central processing unit 1021 to any of the I/O devices 1030, including a PCI bus, a PCI-X bus, or a PCI-Express bus, or a NuBus. For embodiments in which the I/O device is a video display 1024, the processor 1021 may use an Advanced Graphics Port (AGP) to communicate with the display 1024 or the I/O controller 1023 for the display 1024. FIG. 5D depicts an embodiment of a computer 1000 in which the main processor 1021 communicates directly with I/O device 1030*b* or other processors 1021' via HYPERTRANSPORT, RAPIDIO, or INFINIBAND communications technology. FIG. 5D also depicts an embodiment in which local busses and direct communication are mixed: the processor 1021 communicates with I/O device 1030*a* using a local interconnect bus while communicating with I/O device 1030*b* directly.

A wide variety of I/O devices 1030*a*-1030*n* may be present in the computing device 1000. Input devices may include keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include video displays, graphical displays, speakers, headphones, inkjet printers, laser printers, and 3D printers.

Devices 1030*a*-1030*n* may include a combination of multiple input or output devices, including, e.g., Microsoft KINECT, Nintendo Wiimote for the WII, Nintendo WII U GAMEPAD, or Apple IPHONE. Some devices 1030*a*-1030*n* allow gesture recognition inputs through combining some of the inputs and outputs. Some devices 1030*a*-1030*n* provides for facial recognition which may be utilized as an input for different purposes including authentication and other commands. Some devices 1030*a*-1030*n* provides for voice recognition and inputs, including, e.g., Microsoft KINECT, SIRI for IPHONE by Apple, Google Now or Google Voice Search.

Additional devices 1030*a*-1030*n* have both input and output capabilities, including, e.g., haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures. Some touchscreen devices, including, e.g., Microsoft PIXELSENSE or Multi-Touch Collaboration Wall, may have larger surfaces, such as on a table-top or on a wall, and may also interact with other electronic devices. Some I/O devices 1030*a*-1030*n*, display devices 1024*a*-1024*n* or group of devices may be augment reality devices. The I/O devices may be controlled by an I/O controller 1023 as shown in FIG. 5C. The I/O controller may control one or more I/O devices, such as, e.g., a keyboard 1026 and a pointing device 1027, e.g., a mouse or optical pen. Furthermore, an I/O device may also provide storage and/or an installation medium 1016 for the computing device 1000. In still other embodiments, the computing device 1000 may provide USB connections (not shown) to receive handheld USB storage devices. In further embodiments, an I/O device 1030 may be a bridge between the system bus 1050 and an external communication bus, e.g. a USB bus, a SCSI bus, a FireWire bus, an Ethernet bus, a Gigabit Ethernet bus, a Fibre Channel bus, or a Thunderbolt bus.

In some embodiments, display devices 1024*a*-1024*n* may be connected to I/O controller 1023. Display devices may include, e.g., liquid crystal displays (LCD), thin film transistor LCD (TFT-LCD), blue phase LCD, electronic papers (e-ink) displays, flexile displays, light emitting diode displays (LED), digital light processing (DLP) displays, liquid crystal on silicon (LCOS) displays, organic light-emitting diode (OLED) displays, active-matrix organic light-emitting diode (AMOLED) displays, liquid crystal laser displays, time-multiplexed optical shutter (TMOS) displays, or 3D displays. Examples of 3D displays may use, e.g. stereoscopy, polarization filters, active shutters, or autostereoscopy. Display devices 1024*a*-1024*n* may also be a head-mounted display (HMD). In some embodiments, display devices 1024*a*-1024*n* or the corresponding I/O controllers 1023 may be controlled through or have hardware support for OPENGL or DIRECTX API or other graphics libraries.

In some embodiments, the computing device 1000 may include or connect to multiple display devices 1024*a*-1024*n*, which each may be of the same or different type and/or form. As such, any of the I/O devices 1030*a*-1030*n* and/or the I/O controller 1023 may include any type and/or form of suitable hardware, software, or combination of hardware and software to support, enable or provide for the connection and use of multiple display devices 1024*a*-1024*n* by the computing device 1000. For example, the computing device 1000 may include any type and/or form of video adapter, video card, driver, and/or library to interface, communicate, connect or otherwise use the display devices 1024*a*-1024*n*. In one embodiment, a video adapter may include multiple connectors to interface to multiple display devices 1024*a*-1024*n*. In other embodiments, the computing device 1000 may include multiple video adapters, with each video adapter connected to one or more of the display devices 1024*a*-1024*n*. In some embodiments, any portion of the operating system of the computing device 1000 may be configured for using multiple displays 1024*a*-1024*n*. In other embodiments, one or more of the display devices 1024*a*-1024*n* may be provided by one or more other computing devices 1000*a* or 1000*b* connected to the computing device 1000, via the network 1004. In some embodiments software may be designed and constructed to use another computer's display device as a second display device 1024*a* for the computing device 1000. For example, in one embodiment, an Apple iPad may connect to a computing device 1000 and use the display of the device 1000 as an additional display screen that may be used as an extended desktop. One ordinarily skilled in the art will recognize and appreciate the various ways and embodiments that a computing device 1000 may be configured to have multiple display devices 1024*a*-1024*n*.

Referring again to FIG. 5C, the computing device 1000 may comprise a storage device 1028 (e.g. one or more hard disk drives or redundant arrays of independent disks) for storing an operating system or other related software, and for storing application software programs such as any program related to the software 1020 for the experiment tracker system. Examples of storage device 1028 include, e.g., hard disk drive (HDD); optical drive including CD drive, DVD drive, or BLU-RAY drive; solid-state drive (SSD); USB flash drive; or any other device suitable for storing data. Some storage devices may include multiple volatile and non-volatile memories, including, e.g., solid state hybrid drives that combine hard disks with solid state cache. Some storage device 1028 may be non-volatile, mutable, or read-only. Some storage device 1028 may be internal and connect to the computing device 1000 via a bus 1050. Some storage device 1028 may be external and connect to the computing device 1000 via a I/O device 1030 that provides an external bus. Some storage device 1028 may connect to the computing device 1000 via the network interface 1018 over a network 1004, including, e.g., the Remote Disk for MACBOOK AIR by Apple. Some client devices 1000 may not require a non-volatile storage device 1028 and may be thin clients or zero clients 1002. Some storage device 1028 may also be used as a installation device 1016, and may be suitable for installing software and programs. Additionally, the operating system and the software can be run from a bootable medium, for example, a bootable CD, e.g. KNOPPIX, a bootable CD for GNU/Linux that is available as a GNU/Linux distribution from knoppix.net.

Client device 1000 may also install software or application from an application distribution platform. Examples of application distribution platforms include the App Store for iOS provided by Apple, Inc., the Mac App Store provided by Apple, Inc., GOOGLE PLAY for Android OS provided by Google Inc., Chrome Webstore for CHROME OS provided by Google Inc., and Amazon Appstore for Android OS and KINDLE FIRE provided by Amazon.com, Inc. An application distribution platform may facilitate installation of software on a client device 1002. An application distribution platform may include a repository of applications on a server 1006 or a cloud 1008, which the clients 1002*a*-1002*n* may access over a network 1004. An application distribution platform may include application developed and provided by various developers. A user of a client device 1002 may select, purchase and/or download an application via the application distribution platform.

Furthermore, the computing device 1000 may include a network interface 1018 to interface to the network 1004 through a variety of connections including, but not limited to, standard telephone lines LAN or WAN links (e.g., 802.11, T1, T3, Gigabit Ethernet, Infiniband), broadband connections (e.g., ISDN, Frame Relay, ATM, Gigabit Ethernet, Ethernet-over-SONET, ADSL, VDSL, BPON, GPON, fiber optical including FiOS), wireless connections, or some combination of any or all of the above. Connections can be established using a variety of communication protocols (e.g., TCP/IP, Ethernet, ARCNET, SONET, SDH, Fiber Distributed Data Interface (FDDI), IEEE 802.11E/b/g/n/ac CDMA, GSM, WiMax and direct asynchronous connections). In one embodiment, the computing device 1000 communicates with other computing devices 1000' via any type and/or form of gateway or tunneling protocol e.g. Secure Socket Layer (SSL) or Transport Layer Security (TLS), or the Citrix Gateway Protocol manufactured by Citrix Systems, Inc. of Ft. Lauderdale, Fla. The network interface 1018 may comprise a built-in network adapter, network interface card, PCMCIA network card, EXPRESSCARD network card, card bus network adapter, wireless network adapter, USB network adapter, modem or any other device suitable for interfacing the computing device 1000 to any type of network capable of communication and performing the operations described herein.

A computing device 1000 of the sort depicted in FIG. 5B may operate under the control of an operating system, which controls scheduling of tasks and access to system resources. The computing device 1000 can be running any operating system such as any of the versions of the MICROSOFT WINDOWS operating systems, the different releases of the Unix and Linux operating systems, any version of the MAC OS for Macintosh computers, any embedded operating system, any real-time operating system, any open source operating system, any proprietary operating system, any operating systems for mobile computing devices, or any other operating system capable of running on the computing device and performing the operations described herein. Typical operating systems include, but are not limited to: WINDOWS 2000, WINDOWS Server 2012, WINDOWS CE, WINDOWS Phone, WINDOWS XP, WINDOWS VISTA, and WINDOWS 7, WINDOWS RT, and WINDOWS 8 all of which are manufactured by Microsoft Corporation of Redmond, Wash.; MAC OS and iOS, manufactured by Apple, Inc. of Cupertino, Calif.; and Linux, a freely-available operating system, e.g. Linux Mint distribution ("distro") or Ubuntu, distributed by Canonical Ltd. of London, United Kingom; or Unix or other Unix-like derivative operating systems; and Android, designed by Google, of Mountain View, Calif., among others. Some operating systems, including, e.g., the CHROME OS by Google, may be used on zero clients or thin clients, including, e.g., CHROMEBOOKS.

The computer system 1000 can be any workstation, telephone, desktop computer, laptop or notebook computer, netbook, ULTRABOOK, tablet, server, handheld computer, mobile telephone, smartphone or other portable telecommunications device, media playing device, a gaming system, mobile computing device, or any other type and/or form of computing, telecommunications or media device that is capable of communication. The computer system 1000 has sufficient processor power and memory capacity to perform the operations described herein. In some embodiments, the computing device 1000 may have different processors, operating systems, and input devices consistent with the device. The Samsung GALAXY smartphones, e.g., operate under the control of Android operating system developed by Google, Inc. GALAXY smartphones receive input via a touch interface.

In some embodiments, the computing device 1000 is a gaming system. For example, the computer system 1000 may comprise a PLAYSTATION 3, or PERSONAL PLAYSTA- TION PORTABLE (PSP), or a PLAYSTATION VITA device manufactured by the Sony Corporation of Tokyo, Japan, a NINTENDO DS, NINTENDO 3DS, NINTENDO WII, or a NINTENDO WII U device manufactured by Nintendo Co., Ltd., of Kyoto, Japan, an XBOX 360 device manufactured by the Microsoft Corporation of Redmond, Wash.

In some embodiments, the computing device 1000 is a digital audio player such as the Apple IPOD, IPOD Touch, and IPOD NANO lines of devices, manufactured by Apple Computer of Cupertino, Calif. Some digital audio players may have other functionality, including, e.g., a gaming system or any functionality made available by an application from a digital application distribution platform. For example, the IPOD Touch may access the Apple App Store. In some embodiments, the computing device 1000 is a portable media player or digital audio player supporting file formats including, but not limited to, MP3, WAV, M4A/AAC, WMA Protected AAC, RIFF, Audible audiobook, Apple Lossless audio file formats and .mov, .m4v, and .mp4 MPEG-4 (H.264/MPEG-4 AVC) video file formats.

In some embodiments, the computing device 1000 is a tablet e.g. the IPAD line of devices by Apple; GALAXY TAB family of devices by Samsung; or KINDLE FIRE, by Amazon.com, Inc. of Seattle, Wash. In other embodiments, the computing device 1000 is a eBook reader, e.g. the KINDLE family of devices by Amazon.com, or NOOK family of devices by Barnes & Noble, Inc. of New York City, N.Y.

In some embodiments, the communications device 1002 includes a combination of devices, e.g. a smartphone combined with a digital audio player or portable media player. For example, one of these embodiments is a smartphone, e.g. the IPHONE family of smartphones manufactured by Apple, Inc.; a Samsung GALAXY family of smartphones manufactured by Samsung, Inc; or a Motorola DROID family of smartphones. In yet another embodiment, the communications device 1002 is a laptop or desktop computer equipped with a web browser and a microphone and speaker system, e.g. a telephony headset. In these embodiments, the communications devices 1002 are web-enabled and can receive and initiate phone calls. In some embodiments, a laptop or desktop computer is also equipped with a webcam or other video capture device that enables video chat and video call.

In some embodiments, the status of one or more machines 1002, 1006 in the network 1004 is monitored, generally as part of network management. In one of these embodiments, the status of a machine may include an identification of load information (e.g., the number of processes on the machine, CPU and memory utilization), of port information (e.g., the number of available communication ports and the port addresses), or of session status (e.g., the duration and type of processes, and whether a process is active or idle). In another of these embodiments, this information may be identified by a plurality of metrics, and the plurality of metrics can be applied at least in part towards decisions in load distribution, network traffic management, and network failure recovery as well as any aspects of operations of the present solution described herein. Aspects of the operating environments and components described above will become apparent in the context of the systems and methods disclosed herein.

Having now described some illustrative implementations and embodiments, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements and features discussed only in connection with one embodiment are not intended to be excluded from a similar role in other implementations or embodiments.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate embodiments consisting of the items listed thereafter exclusively. In one embodiment, the systems and methods described herein consist of one, each combination of more than one, or all of the described elements, acts, or components.

Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements to single or plural configurations. References to any act or element being based on any information, act or element may include embodiments where the act or element is based at least in part on any information, act, or element.

Any implementation disclosed herein may be combined with any other implementation or embodiment, and references to "an implementation," "some implementations," "an alternate implementation," "various implementation," "one implementation" or the like are not necessarily mutually exclusive and are intended to indicate that a particular feature, structure, or characteristic described in connection with the embodiment may be included in at least one implementation or embodiment. Such terms as used herein are not necessarily all referring to the same embodiment. Any embodiment may be combined with any other embodiment, inclusively or exclusively, in any manner consistent with the aspects and embodiments disclosed herein.

References to "or" may be construed as inclusive so that any terms described using "or" may indicate any of a single, more than one, and all of the described terms.

Where technical features in the drawings, detailed description or any claim are followed by reference signs, the reference signs have been included for the sole purpose of increasing the intelligibility of the drawings, detailed description, and claims. Accordingly, neither the reference signs nor their absence have any limiting effect on the scope of any claim elements.

The systems and methods described herein may be embodied in other specific forms without departing from the characteristics thereof. For example, the criteria, combination indicators and queries can be provided in Boolean form or other languages, tree structures, or contextual query languages or grammar forms. Content can be identified for display on web pages or with other information resources such as websites, domain names, or uniform resource locators. Further, identifying content for display with web pages or other information resources can include identifying content as being suitable for display (e.g., as a candidate for display) with the information resource. The suitable content can be evaluated against other suitable content, e.g., in an auction, with a winning content item selected from the auction and provided for display with a rendering of a web page or other information resource. The foregoing embodiments are illustrative rather than limiting of the described systems and methods. Scope of the systems and methods described herein is thus indicated by the appended claims, rather than the foregoing description, and changes that come within the meaning and range of equivalency of the claims are embraced therein.

What is claimed:

1. A system for helmet rentals, the system comprising:

a kiosk;

a compartment for storing helmets within a housing of the kiosk, the compartment comprising a dispensing unit with one or more vertical rods, each of the one or more vertical rods configured to hold a plurality of helmets in a vertical stacking arrangement and comprising a quick release configured to release the respective vertical rod from the dispensing unit;

a release mechanism coupled to the one or more vertical rods to release one of the plurality of helmets responsive to a signal to release a helmet of the plurality of helmets; and a drawer coupled with the housing of the kiosk, the drawer configured to receive a return of the helmet.

2. The system of claim 1, wherein the dispensing unit further comprises at least three vertical rods.

3. The system of claim 1, wherein each of the one or more vertical rods is configured to hold at least six helmets.

4. The system of claim 1, further comprising a communications module to transmit an indication that the dispensing unit released the one of the plurality of helmets.

5. The system of claim 1, further comprising a communications module to transmit an indication that the one of the plurality of helmets was placed in the drawer.

6. The system of claim 1, further comprising a communications module to transmit an indication when a number of helmets stored in the dispensing unit falls below a predetermined threshold or a second indication when a number of helmets returned to the system rises above a second predetermined threshold.

7. The system of claim 1, wherein the kiosk comprises one or more solar panels to power the system.

8. The system of claim 1, wherein, upon release of the one of the plurality of helmets by the release mechanism, the one of the plurality of helmets is released from a bottom of the vertical stacking arrangement.

9. The system of claim 1, further comprising an interface to receive a request from a bike sharing system to release the one of the plurality of helmets.

10. A method of dispensing a helmet, the method comprising:

providing, by a kiosk, an interface to receive a request to dispense a helmet;

determining, by a controller, to dispense the helmet responsive to receiving a request at the kiosk;

transmitting, by the controller responsive to the determination, a signal to a dispensing unit to release the helmet, the dispensing unit comprising one or more vertical rods configured to hold a plurality of helmets in a vertical stacking arrangement; and releasing, by a release mechanism within the dispensing unit, the helmet from the one or more vertical rods; and replacing one of the one or more vertical rods with a second vertical rod, the second vertical rod configured to hold a plurality of helmets to refill the dispensing unit with helmets.

11. The method of claim 10, wherein the dispensing unit further comprises at least three vertical rods.

12. The method of claim 10, wherein each of the one or more vertical rods is configured to hold at least six helmets.

13. The method of claim 10, further comprising transmitting, by a communications module, an indication that the helmet was released from the kiosk.

14. The method of claim 10, further comprising transmitting, by a communications module, an indication that the helmet was returned to the kiosk.

15. The method of claim 10, further comprising transmitting, by a communications module, an indication that a number of helmets stored in the dispensing unit is below a predetermined threshold or a second indication when a number of helmets returned to the system is above a second predetermined threshold.

16. The method of claim 10, further comprising receiving, by a return system, the helmet.

17. The method of claim 10, further comprising powering the kiosk with one or more solar panels.

18. The method of claim 10, further comprising receiving the request from a bike sharing system.

* * * * *